US008240278B2

(12) United States Patent
Jeon et al.

(10) Patent No.: US 8,240,278 B2
(45) Date of Patent: Aug. 14, 2012

(54) ENGINE BRAKE AND ENGINE PROVIDED WITH THE SAME

(75) Inventors: Jae Hee Jeon, Suwon-si (KR); Yong Wook Yu, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 174 days.

(21) Appl. No.: 12/784,825

(22) Filed: May 21, 2010

(65) Prior Publication Data

US 2011/0114060 A1 May 19, 2011

(30) Foreign Application Priority Data

Nov. 19, 2009 (KR) ..... 10-2009-0112277

(51) Int. Cl.
*F01L 9/02* (2006.01)
*F01L 1/18* (2006.01)
*F02D 13/04* (2006.01)

(52) U.S. Cl. ..... 123/90.12; 123/90.39; 123/90.46; 123/321

(58) Field of Classification Search ..... 123/90.12, 123/90.16, 90.39, 90.4, 90.46, 321
See application file for complete search history.

(56) References Cited

U.S. PATENT DOCUMENTS

| | | | | |
|---|---|---|---|---|
| 6,253,730 | B1 * | 7/2001 | Gustafson | 123/321 |
| 6,386,160 | B1 * | 5/2002 | Meneely et al. | 123/90.16 |
| 6,422,186 | B1 * | 7/2002 | Vanderpoel | 123/90.15 |
| 6,594,996 | B2 * | 7/2003 | Yang | 60/602 |
| 6,691,674 | B2 * | 2/2004 | McCarthy et al. | 123/321 |
| 7,140,333 | B2 * | 11/2006 | Persson et al. | 123/90.16 |
| 7,673,600 | B2 * | 3/2010 | Yang | 123/90.16 |
| 8,065,987 | B2 * | 11/2011 | Yang | 123/321 |
| 2007/0175441 | A1 * | 8/2007 | Jeong et al. | 123/321 |
| 2008/0087239 | A1 * | 4/2008 | Wiley et al. | 123/90.16 |
| 2010/0307451 | A1 * | 12/2010 | Lee et al. | 123/321 |
| 2010/0319657 | A1 * | 12/2010 | Dodi et al. | 123/321 |
| 2011/0023821 | A1 * | 2/2011 | Yoon et al. | 123/321 |
| 2011/0067673 | A1 * | 3/2011 | Yoon et al. | 123/321 |
| 2011/0073068 | A1 * | 3/2011 | Yoon et al. | 123/321 |
| 2011/0132298 | A1 * | 6/2011 | Ruggiero et al. | 123/90.12 |

* cited by examiner

*Primary Examiner* — Hai Huynh
(74) *Attorney, Agent, or Firm* — Morgan, Lewis & Bockius LLP

(57) ABSTRACT

An engine brake may include a rocker shaft, a rocker arm pivoting around the rocker shaft, an actuator piston disposed to the rocker arm and selectively protruded there from, a stopper disposed to a corresponding position of the actuator piston for the rocker arm to open a valve when the actuator piston is protruded and a hydraulic pressure supply portion selectively supplying hydraulic pressure to the actuator piston.

12 Claims, 13 Drawing Sheets

ENGINE BRAKE AND ENGINE PROVIDED WITH THE SAME

CROSS-REFERENCE TO RELATED APPLICATION

The present application claims priority to Korean Patent Application No. 10-2009-0112277 filed on Nov. 19, 2009, the entire contents of which is incorporated herein for all purposes by this reference.

BACKGROUND OF THE INVENTION

1. Field of the Invention

The present invention related to an engine brake and an engine provided with the same. More particularly, the present invention relates to an engine brake with simple scheme and rapid response and an engine provided with the same.

2. Description of Related Art

An auxiliary brake for assisting and enhancing durability of a foot brake is broadly used in a vehicle.

An engine brake, one of the auxiliary brakes, opens an exhaust valve of an engine to reduce a vehicle speed by using fluctuation of pressure in a cylinder.

The engine brake requires elements for opening the exhaust valve, but the element are complicatedly combined and requires high oil pressure to operate the engine brake and also responsiveness is not sufficiently fast.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine brake and an engine provided with the same having advantages of rapid response with simple scheme and operating with relatively low oil pressure.

In an aspect of the present invention, the engine brake may include a rocker shaft, a rocker arm pivoting around the rocker shaft, an actuator piston disposed to the rocker arm and selectively protruded therefrom, a stopper disposed to a corresponding position of the actuator piston with a predetermined distance for the rocker arm to open a valve when the actuator piston is protruded, and a hydraulic pressure supply portion fluid-connected to the actuator piston and selectively supplying hydraulic pressure to the actuator piston, wherein the rocker arms are provided as a plurality, and the hydraulic pressure supply portion selectively supplies hydraulic pressure to each actuator piston disposed to the plurality of rocker arms.

The hydraulic pressure supply portion may include a solenoid valve selectively opening an oil passage to the actuator piston, a hydraulic pressure control portion that is opened according to hydraulic pressure in the oil passage opened by the solenoid valve, and a hydraulic pressure supply line connecting each of the actuator pistons and the hydraulic pressure control portion.

The hydraulic pressure control portion may include a housing connected to the solenoid valve, a supply hole formed to the housing, an exhaust hole formed to the housing, a hydraulic piston that is movably disposed within the housing for selectively supplying hydraulic pressure to the hydraulic pressure supply line via the supply hole or releasing hydraulic pressure of the hydraulic pressure supply line through the exhaust hole according to operations of the solenoid valve, and a hydraulic piston spring elastically biasing the hydraulic piston to open a fluid communication between the supply hole and the exhaust hole in the housing.

The hydraulic pressure control portion may further include a hydraulic piston stopper that is disposed between the supply hole and the exhaust hole for the hydraulic piston to close fluid communication between the exhaust hole and the supply hole and to open fluid communication between the oil passage and the supply hole when the engine brake operates.

The hydraulic piston may include protrude portions that close fluid communication between the supply hole and the exhaust hole when the engine brake operates, a recess portion formed between the protrude portions for supplying hydraulic pressure of the oil passage to the supply hole when the engine brake operates, and a chamber formed within the hydraulic piston and fluid-connected to the recess portion to supply hydraulic pressure of the oil passage to the supply hole through the recess portion.

The hydraulic pressure control portion may further include a plate disposed to a front portion of the hydraulic piston and having a plate hole fluid-connected to the oil passage, a check ball disposed between the plate and the hydraulic piston to selectively open the chamber, and a check ball spring disposed within the chamber for elastically biasing the check ball toward the plate hole of the plate.

The hydraulic pressure supply line may include rocker arm hydraulic pressure lines formed in each of the rocker arms and fluid-connected to the actuator piston, a rocker shaft hydraulic pressure line formed in the rocker shaft and connected to the rocker arm hydraulic pressure lines for supplying hydraulic pressure thereto, and a control portion hydraulic pressure line connecting the rocker shaft hydraulic pressure lines and the supply hole.

The hydraulic pressure control portion may include a housing connected to the solenoid valve, a supply hole formed to the housing, an exhaust hole formed to the housing, a hydraulic piston stopper disposed between the supply hole and the exhaust hole, a hydraulic piston disposed within the housing, and a hydraulic piston spring elastically biasing the hydraulic piston to open fluid communication between the supply hole and the exhaust hole in the housing.

The hydraulic piston may include protrude portions, a recess portion formed between the protrude portions for supplying hydraulic pressure of the oil passage to the supply hole when the engine brake operates, and a chamber formed within the hydraulic piston and fluid-connected to the recess portion to supply hydraulic pressure of the oil passage to the supply hole through the recess portion, and the hydraulic pressure control portion further comprises a plate disposed to a front portion of the hydraulic piston and having a plate hole fluid-connected to the oil passage, a check ball disposed between the plate and the hydraulic piston to selectively open the chamber, and a check ball spring disposed within the chamber for elastically biasing the check ball toward the plate hole of the plate, wherein the protrude portions close fluid communication between the supply hole and the exhaust hole when the engine brake operates, and wherein the recess portion formed between the protrude portions supplies hydraulic pressure of the oil passage to the supply hole when the engine brake operates The hydraulic pressure supply line may include rocker arm hydraulic pressure lines formed in each of the rocker arms and fluid-connected to the actuator piston, a rocker shaft hydraulic pressure line formed in the rocker shaft and connected to the rocker arm hydraulic pressure lines for supplying hydraulic pressure thereto, and a control portion hydraulic pressure line connecting the rocker shaft hydraulic pressure line and the supply hole.

The engine brake may further include a clearance adjustment screw disposed to the stopper for adjusting clearance.

As described above, an engine brake and an engine provided with the same according to an exemplary embodiment of the present invention may respond rapidly with simple scheme and operate with relatively low oil pressure.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
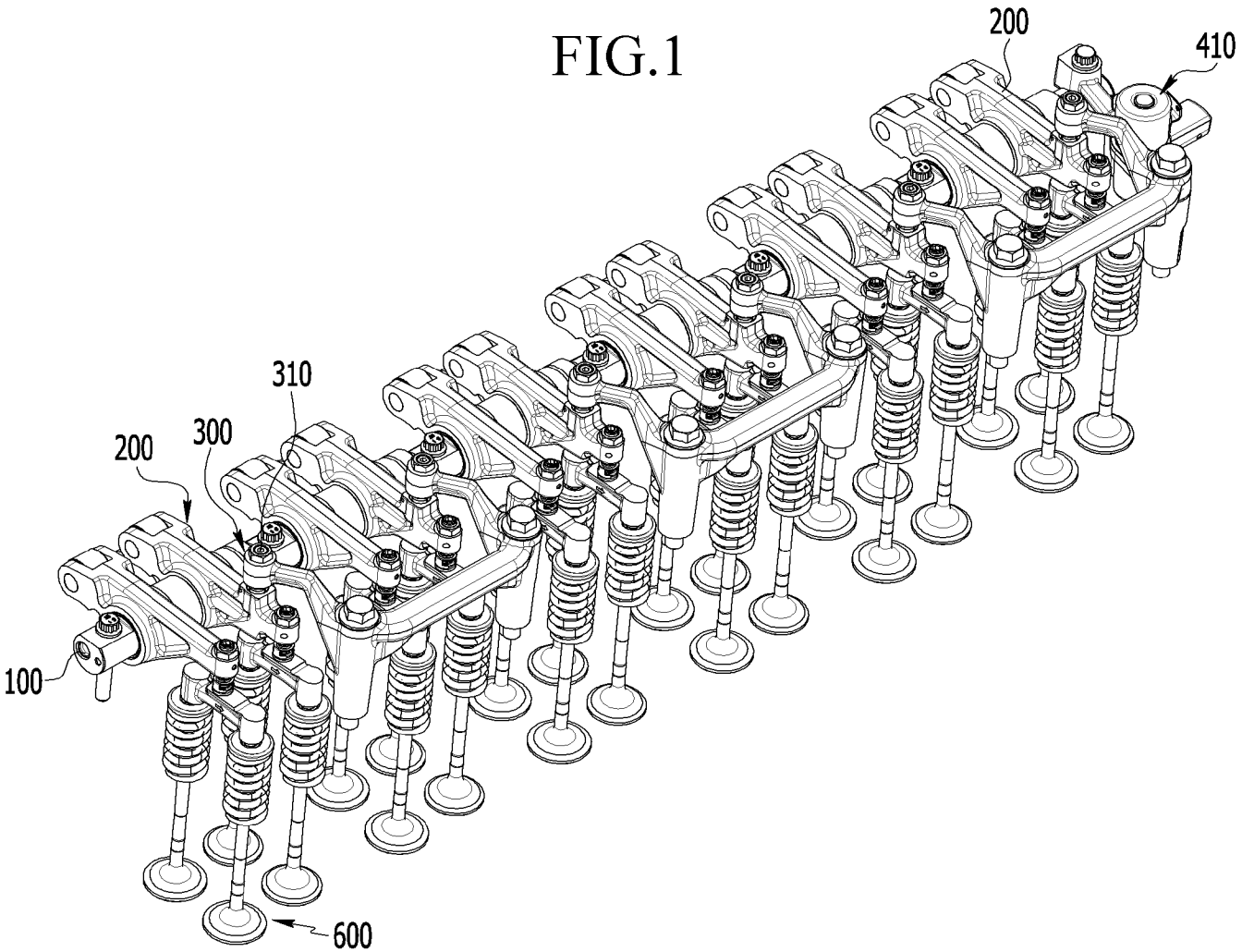
FIG. 1 is a perspective view of an exemplary engine brake according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
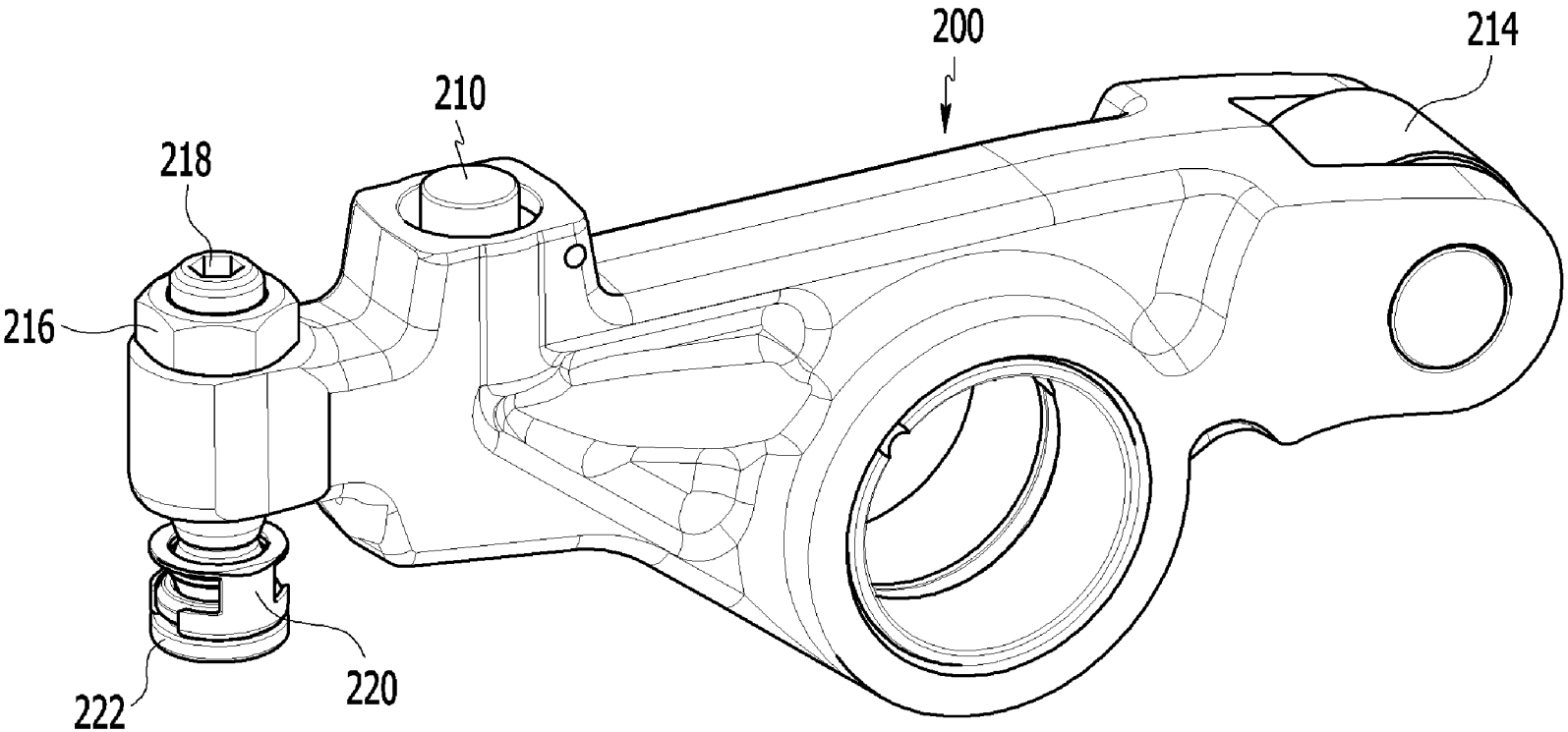
FIG. 2 is a perspective view of a rocker arm of an exemplary engine brake according to the present invention.

FIG. 1 is a perspective view of an engine brake according to an exemplary embodiment of the present invention and FIG. 2 is a perspective view of a rocker arm of an engine brake according to an exemplary embodiment of the present invention.

Referring to FIG. 1 and FIG. 2, an engine brake according to an exemplary embodiment of the present invention a rocker shaft 100, a rocker arm 200 pivoting around the rocker shaft 100, an actuator piston 210 disposed to the rocker arm 200 and selectively protruded therefrom, a stopper 300 disposed to a corresponding position of the actuator piston 210 for the rocker arm 200 to open a valve 600 when the actuator piston 210 is protruded and a hydraulic pressure supply portion 400 (referring to FIG. 5) selectively supplying hydraulic pressure to the actuator piston 210.

It is preferable that the rocker arm 200 is an exhaust rocker arm and the valve 600 is an exhaust valve, A clearance adjustment screw 310 is disposed to the stopper 300 for adjusting clearance.

The rocker arms 200 are provided as a plurality and the hydraulic pressure supply portion 400 selectively supplies hydraulic pressure to each of the actuator piston 210 disposed to the plurality of rocker arm 200.

That is, the engine brake according to an exemplary embodiment of the present invention may operates a plurality of rocker arm 200 with one hydraulic pressure supply portion 400 so that total number of elements forming the engine brake can be reduced and response time can be reduced.

Figure 3:
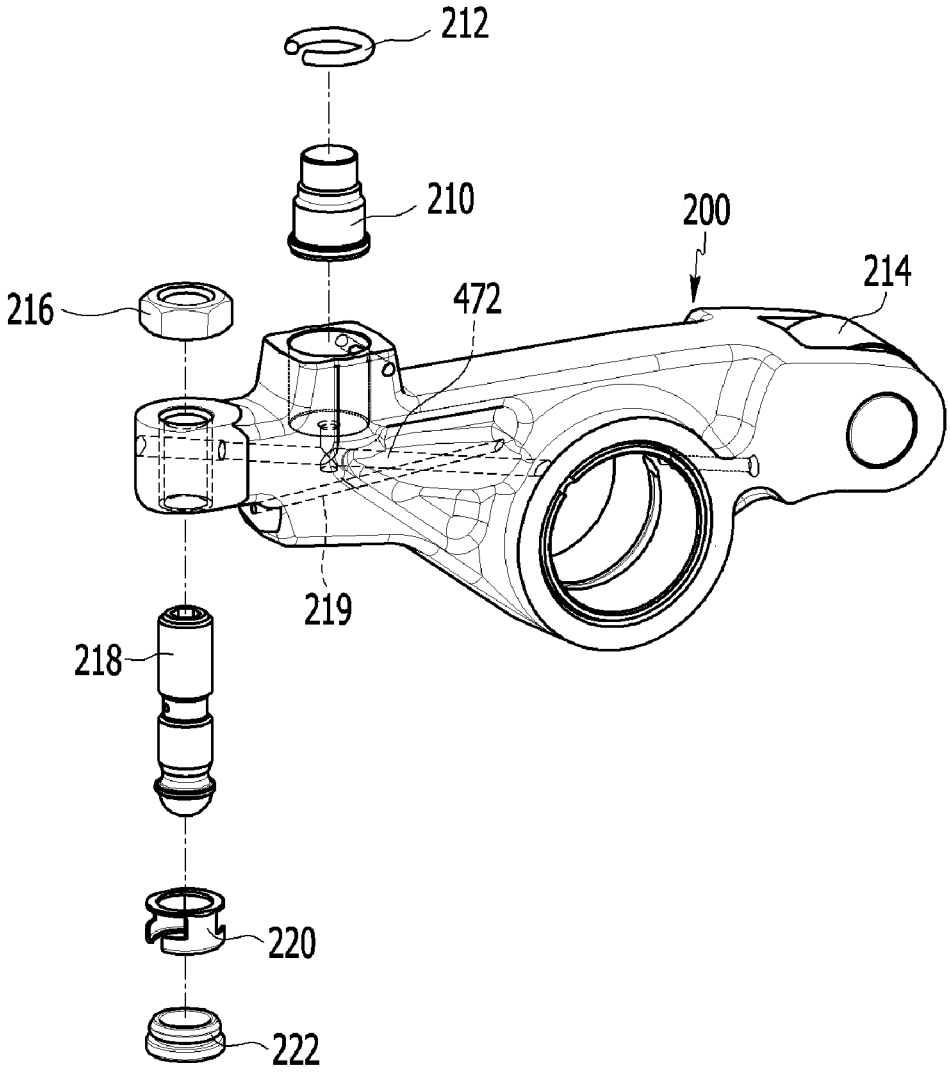
FIG. 3 is an exploded view of FIG. 2.

FIG. 3 is an exploded view of FIG. 2.

Figure 10:
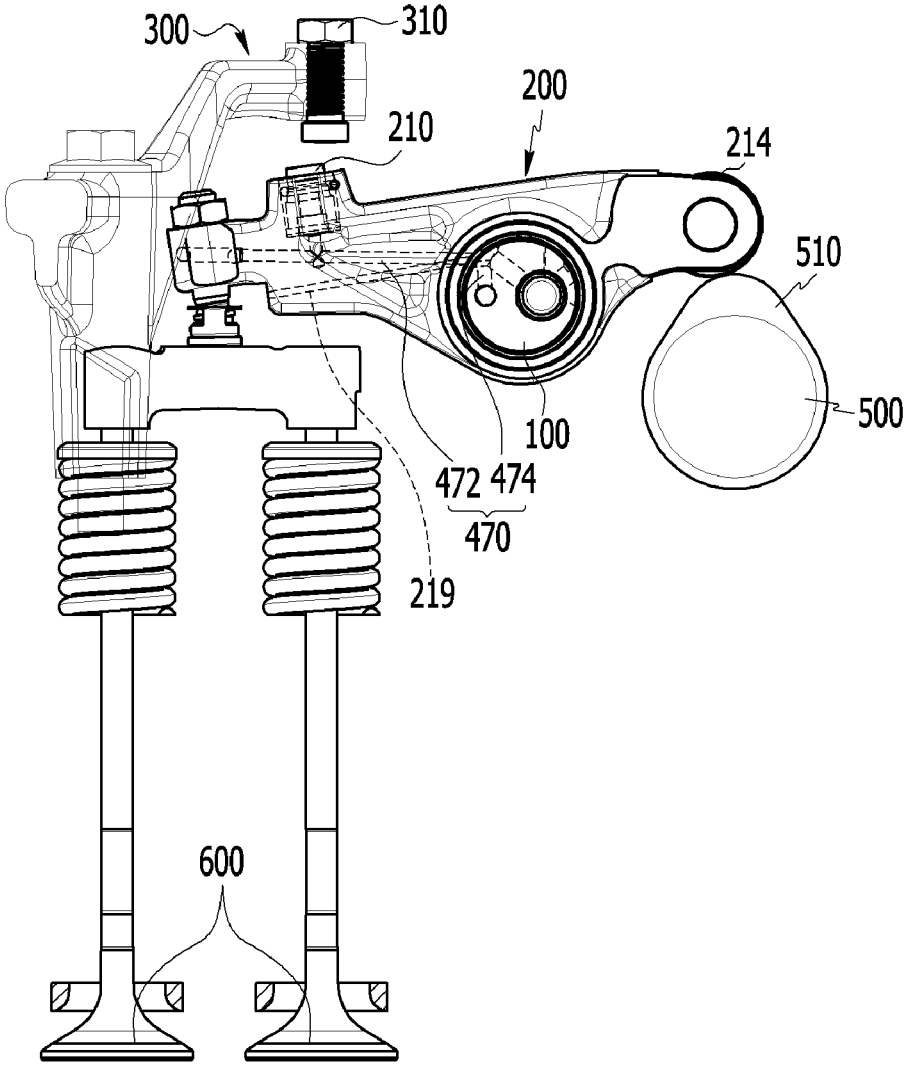
FIG. 10 and FIG. 11 are drawings showing opening and closing of a valve when an exemplary engine brake according to the present invention is not operated.

Referring to FIG. 2 and FIG. 3, the rocker arms 200 of the engine brake according to an exemplary embodiment of the present invention includes the actuator piston 210, a displacement control snap ring 212 for controlling displacement of the actuator piston 210, a bolt 216 for mounting the valve 600, an adjust screw 218, a retainer 220, a socket ball 222 and a roller 214 that contacts a cam 510 as shown in FIG. 10. A rocker arm hydraulic pressure line 472, one of a hydraulic pressure supply line 470 that will be explained later, and a lubrication line 219 are formed within the rocker arm 200, and scheme of the rocker arm 200 is simple so that manufacturing cost can be reduced.

Figure 4:
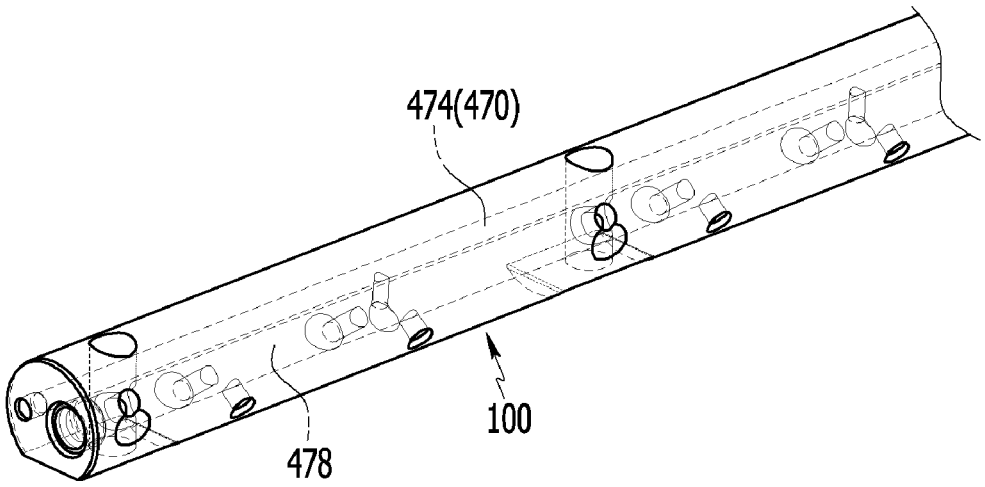
FIG. 4 is a drawing showing a rocker shaft of an exemplary engine brake according to the present invention.

FIG. 4 is a drawing showing a rocker shaft of an engine brake according to an exemplary embodiment of the present invention.

As shown in FIG. 4, a rocker shaft hydraulic pressure line 474 one of a hydraulic pressure supply line 470 that will be explained later, and a lubrication line 478 are formed within the rocker shaft 100 and hydraulic pressure can be supplied through the rocker shaft hydraulic pressure line 474 to each of the rocker arm hydraulic pressure line 472 so that response time of the engine brake can be reduced.

Figure 5:
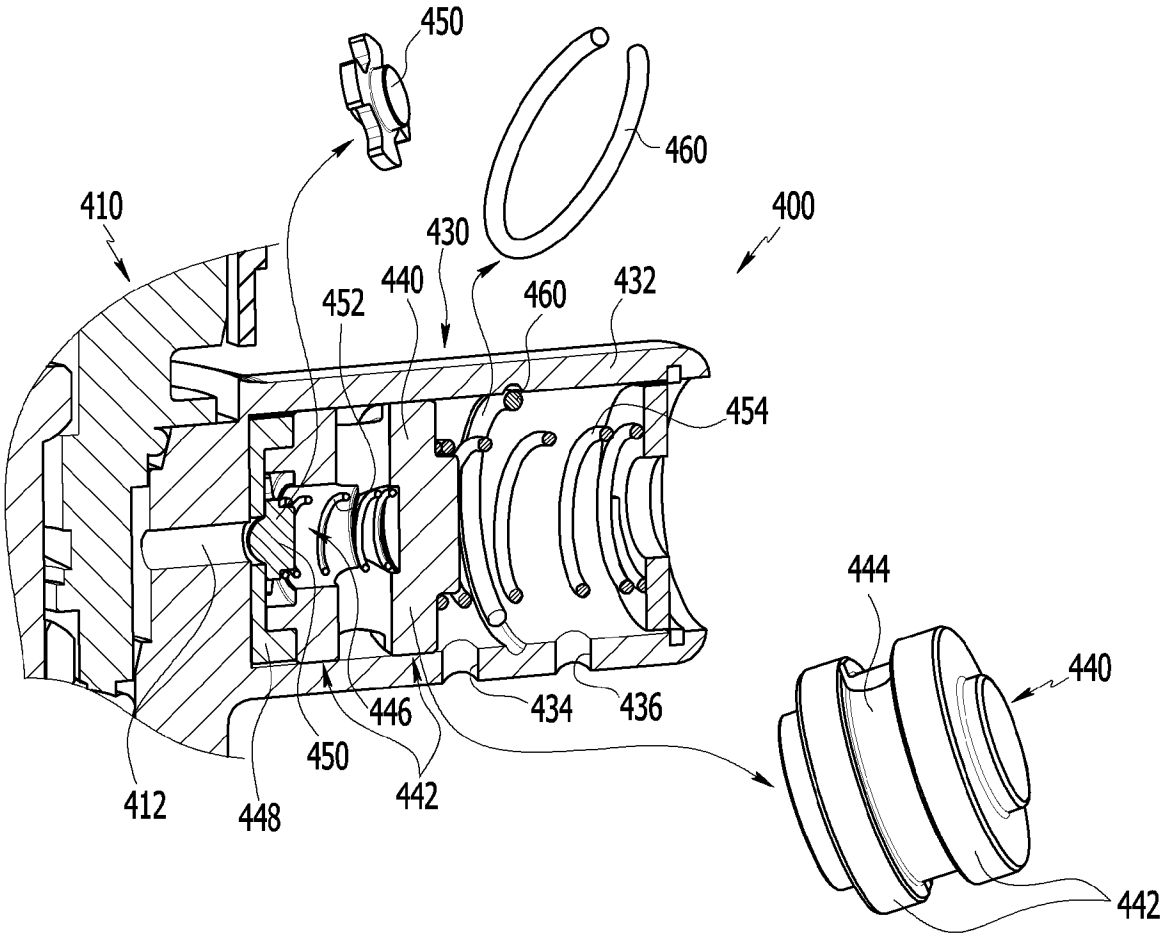
FIG. 5 is a cross-sectional view of a hydraulic pressure control portion of an exemplary engine brake according to the present invention.
Figure 6:
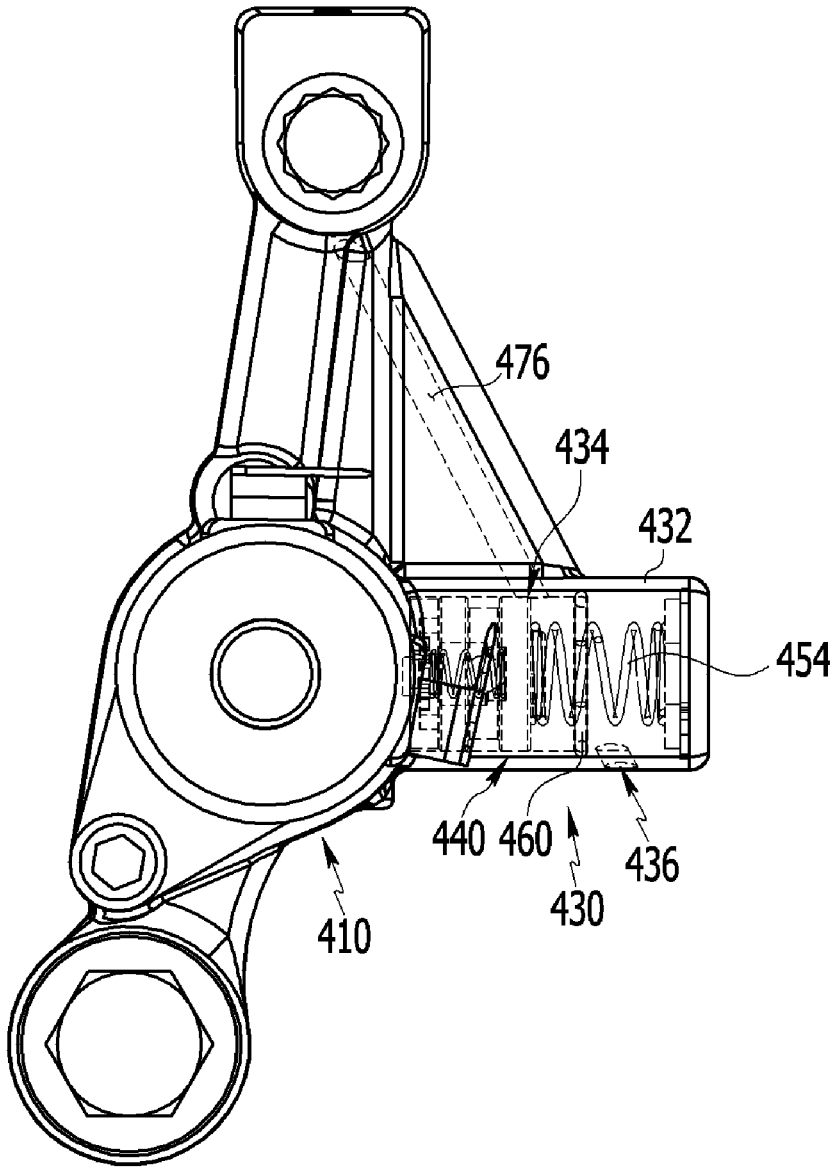
FIG. 6 is a plain cross-sectional view of a hydraulic pressure control portion of an exemplary engine brake according to the present invention.

FIG. 5 is a cross-sectional view of a hydraulic pressure control portion of an engine brake according to an exemplary embodiment of the present invention and FIG. 6 is a plain cross-sectional view of a hydraulic pressure control portion of an engine brake according to an exemplary embodiment of the present invention.

Figure 7:
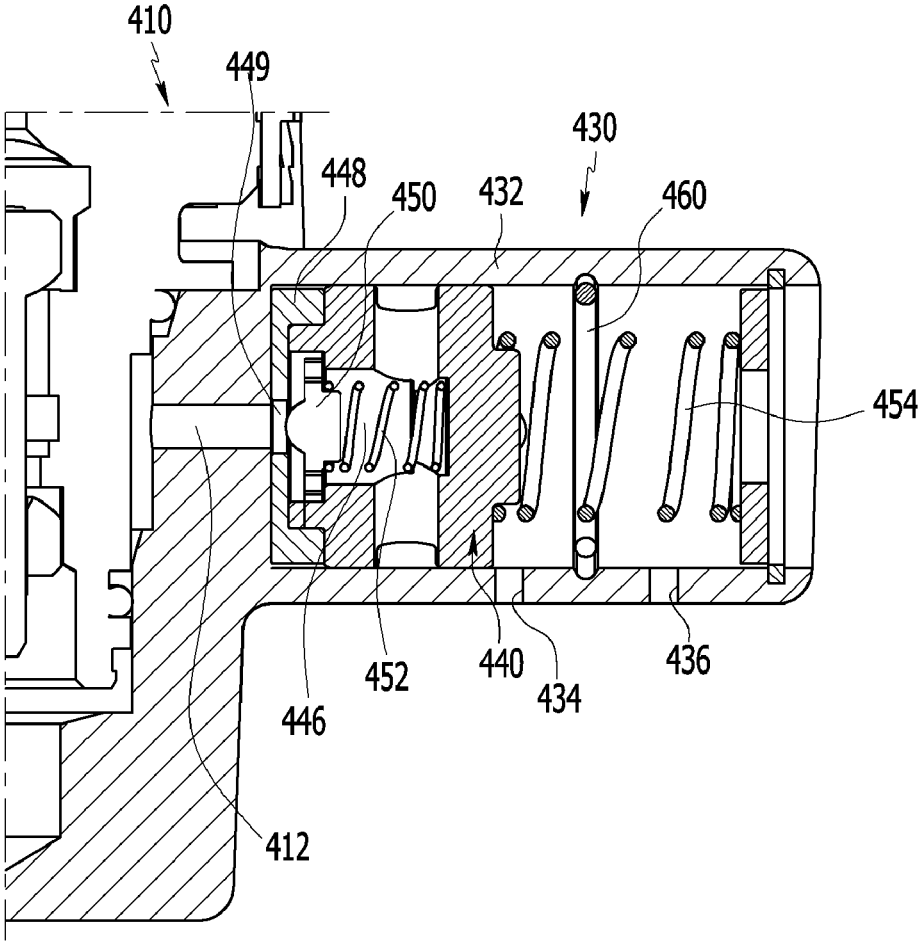
FIG. 7 is a cross-sectional view showing a hydraulic pressure control portion of an exemplary engine brake according to the present invention in initial state of supplying hydraulic pressure.
Figure 8:
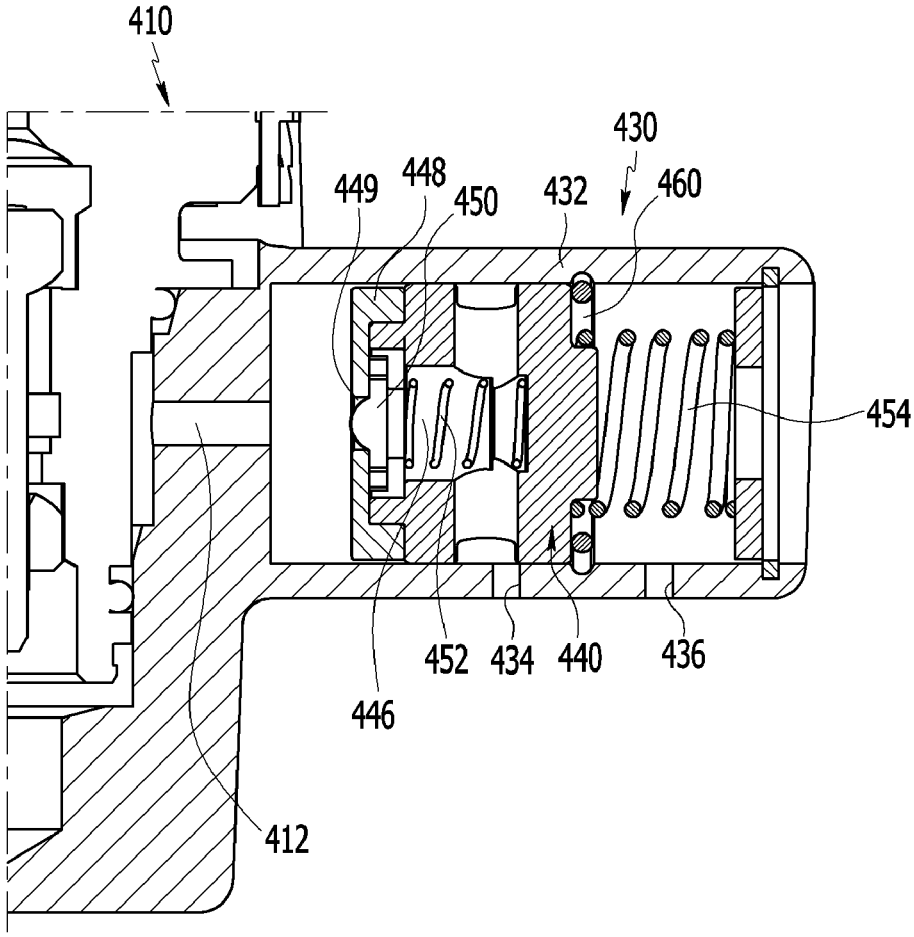
FIG. 8 is a cross-sectional view showing a hydraulic pressure control portion of an exemplary engine brake according to the present invention of supplying hydraulic pressure.
Figure 9:
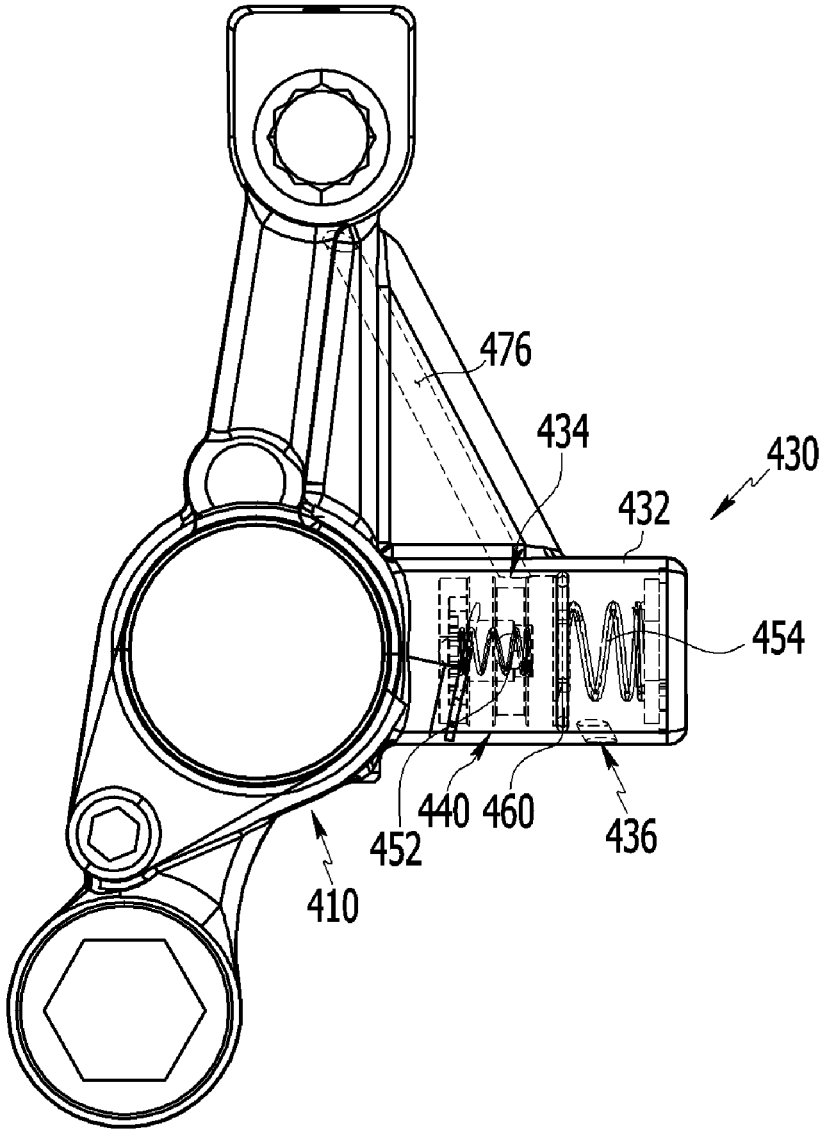
FIG. 9 is a cross-sectional view showing a hydraulic pressure control portion of an exemplary engine brake according to the present invention of supplying hydraulic pressure.

FIG. 7 is a cross-sectional view showing a hydraulic pressure control portion of an engine brake according to an exemplary embodiment of the present invention in initial state of supplying hydraulic pressure, FIG. 8 is a cross-sectional view showing a hydraulic pressure control portion of an engine brake according to an exemplary embodiment of the present invention of supplying hydraulic pressure and FIG. 9 is a cross-sectional view showing a hydraulic pressure control portion of an engine brake according to an exemplary embodiment of the present invention of supplying hydraulic pressure.

Referring to FIG. 5 to FIG. 9, the hydraulic pressure supply portion 400 includes a solenoid valve 410 selectively opening an oil passage 412, a hydraulic pressure control portion 430 that is opened according to opening of the oil passage 412 opened by the solenoid valve 410 and a hydraulic pressure supply line 470.

The hydraulic pressure control portion 430 includes a housing 432 connected to the solenoid valve 410, a supply hole 434 (referring to FIG. 9) formed to the housing 432, an exhaust hole 436 (referring to FIG. 9 formed to the housing 432, a hydraulic piston 440 that is movably disposed within the housing 432 for selectively supplying hydraulic pressure to the hydraulic pressure supply line 470 via the supply hole 434 or releasing hydraulic pressure through the exhaust hole 436 according to operations of the solenoid valve 410 and a hydraulic piston spring 454 elastically supporting the hydraulic piston 440 in the housing 432.

The hydraulic pressure supply line 470 includes the rocker arm hydraulic pressure lines 472 formed to each of the rocker arms 200 for connecting the actuator piston 210 and the rocker shaft 100 as shown in FIG. 3, the rocker shaft hydraulic pressure line 474 formed to the rocker shaft 100 for supplying hydraulic pressure to the rocker arm hydraulic pressure lines 472 as shown in FIG. 4 and a control portion hydraulic pressure line 476 connecting the rocker shaft hydraulic pressure line 474 and the supply hole 434 as shown in FIG. 6.

The hydraulic pressure control portion 430, as shown in FIG. 5, further includes a hydraulic piston stopper 460 that is disposed between the supply hole 434 and the exhaust hole 436 for the hydraulic piston 440 to close fluid communication between the supply hole 434 and the exhaust hole 436 and to open fluid communication between the oil passage 412 and the supply hole 434 when the engine brake operates.

The hydraulic piston 440 includes a protrude portion 442 that closes fluid communication between the supply hole 434 and the exhaust hole 436 when the engine brake operates, a recess portion 444 formed between the protrude portion 442 for supplying hydraulic pressure of the oil passage 412 to the supply hole 434 when the engine brake operates and a chamber 446 formed within the hydraulic piston 440 that is supplied hydraulic pressure from the oil passage 412 and supplies hydraulic pressure to the supply hole 434 through the recess portion 444.

The hydraulic pressure control portion 430 further includes a plate 448 disposed to front portion of the hydraulic piston 440, a check ball 450 disposed between the plate 448 and the hydraulic piston 440 and a check ball spring 452 disposed within the chamber 446 for elastically supporting the check ball 450.

The check ball 450 and the check ball spring 452 permits operation oil to flow through the oil passage 412 and prevent from flowing backward.

Figure 11:
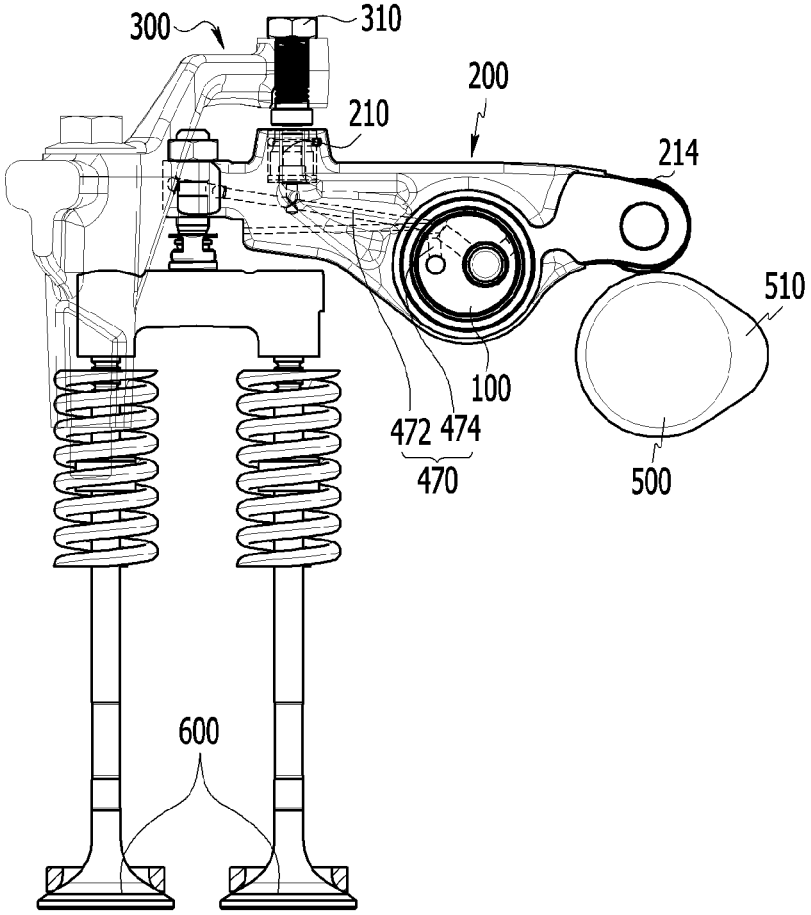
Figure 12:
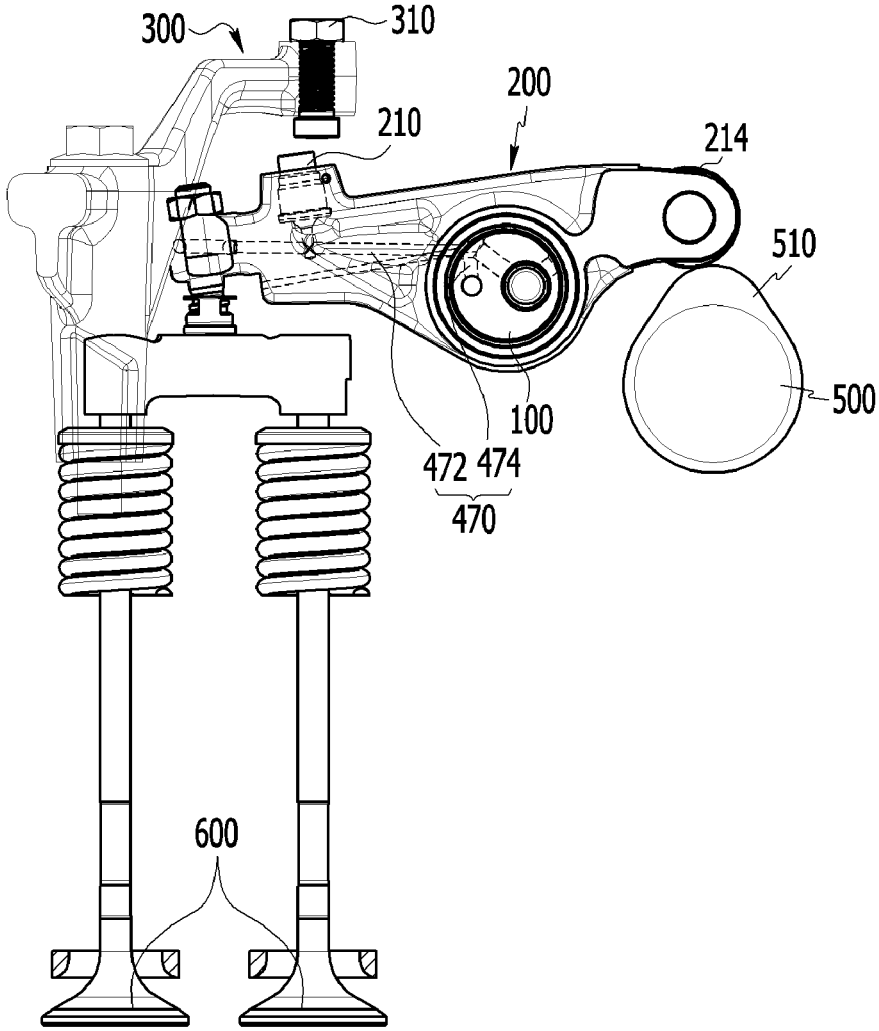
FIG. 12 and FIG. 13 are drawings showing closing of a valve when an exemplary engine brake according to the present invention is operated.
Figure 13:
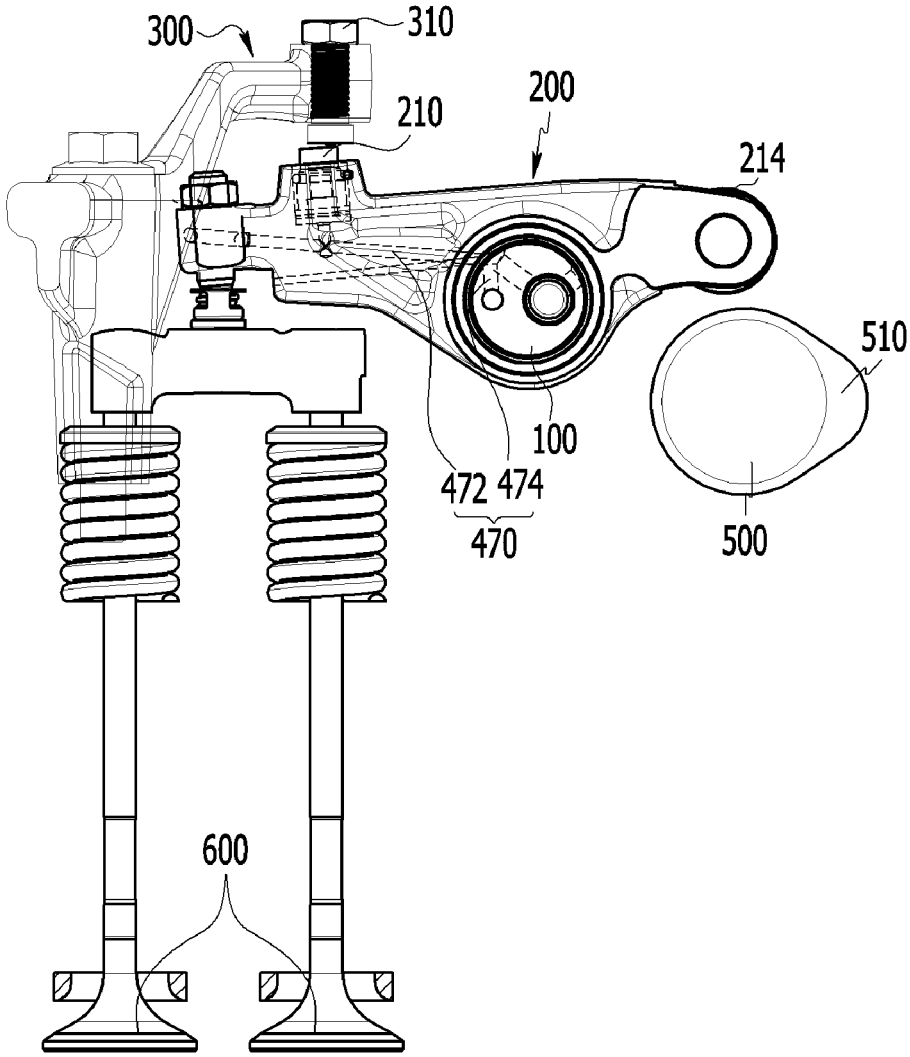

FIG. 10 and FIG. 11 are drawings showing opening and closing of a valve when an engine brake according to an exemplary embodiment of the present invention is not operated and FIG. 12 and FIG. 13 are drawings showing closing of a valve when an engine brake according to an exemplary embodiment of the present invention is operated.

Operation of the engine brake according to an exemplary embodiment of the present invention will hereinafter be described with reference to FIG. 6 to FIG. 13.

When the engine brake is not operated, as shown in FIG. 6, the exhaust hole 436 is opened and a fluid communication between the exhaust hole 436 and the supply hole 434 may be formed.

Thus, as shown in FIG. 10 and FIG. 11, the roller 214 contacts the cam disposed to the rotating cam shaft 500, the rocker arm 200 pivots around the rocker shaft 100 and then the valve is normally opened and closed.

When a driver decrease vehicle speed, an ECU (electronic control unit, not shown) outputs engine brake operating signals to the solenoid valve 410.

Referring to FIG. 7 to FIG. 9, the solenoid valve 410 opens the oil passage 412 to supply operating fluid and the operating fluid flows into the camber 446 through a plate hole 449 formed to the plate 448.

And then, the operating fluid pushes the hydraulic piston 440 to contact the hydraulic piston stopper 460.

So the hydraulic piston 440 closes fluid communication between the supply hole 434 and the exhaust hole 436 and opens fluid communication between the oil passage 412 and the supply hole 434 to supply hydraulic pressure supplied from the chamber 446 to each of the actuator piston 210 through the supply hole 434.

Then, as shown in FIG. 12, the actuator piston 210 protrudes and contacts the stopper 300 as shown in FIG. 13, and the valve 600 is maintained opened state.

With that operations, reciprocations of a piston (not shown) in a cylinder (not shown) induces fluctuation of pressure in the cylinder and vehicle reduces its speed.

As shown in FIG. 9, the hydraulic pressure supply line 470 forms a closed circuit so that the engine brake can be operated with relatively low hydraulic pressure.

After that, when normal engine operation is required, a oil pump supplying oil to the oil passage 412 is not operated and the solenoid valve 410 opens the oil passage 412

Then the hydraulic piston 440 is returned to original position by elastic force of the hydraulic piston spring 454 as shown in FIG. 6, fluid communication between the exhaust hole 436 and the supply hole 434 is opened and pressure in the hydraulic pressure supply line 470 is released through the exhaust hole 436.

Thus, the engine operates normally.

As described above, the engine brake according to an exemplary embodiment of the present invention and the engine provided with the engine brake may maintain opening state of the valve with relatively low operating pressure and simple scheme and rapid response may be achieved.

For convenience in explanation and accurate definition in the appended claims, the term "front" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof.

It is intended that the scope of the invention be defined by the Claims appended hereto and their equivalents.

What is claimed is:

1. An engine brake comprising:
a rocker shaft;
a rocker arm pivoting around the rocker shaft;
an actuator piston disposed to the rocker arm and selectively protruded therefrom;
a stopper disposed to a corresponding position of the actuator piston with a predetermined distance for the rocker arm to open a valve when the actuator piston is protruded; and
a hydraulic pressure supply portion fluid-connected to the actuator piston and selectively supplying hydraulic pressure to the actuator piston,
wherein the rocker arms are provided as a plurality;
wherein the hydraulic pressure supply portion selectively supplies hydraulic pressure to each actuator piston disposed to the plurality of rocker arms;
wherein the hydraulic pressure supply portion includes:
a solenoid valve selectively opening an oil passage to the actuator piston;
a hydraulic pressure control portion that is opened according to hydraulic pressure in the oil passage opened by the solenoid valve;
a hydraulic pressure supply line connecting each of the actuator pistons and the hydraulic pressure control portion,
a housing connected to the solenoid valve via the oil passage;
a supply hole formed to the housing;
an exhaust hole formed to the housing;
a hydraulic piston that is movably disposed within the housing for selectively supplying hydraulic pressure to the hydraulic pressure supply line via the supply hole or releasing hydraulic pressure of the hydraulic pressure supply line through the exhaust hole according to operations of the solenoid valve; and
a hydraulic piston spring elastically biasing the hydraulic piston to open a fluid communication between the supply hole and the exhaust hole in the housing; and
wherein the hydraulic piston comprises:
protrude portions that close fluid communication between the supply hole and the exhaust hole when the engine brake operates;
a recess portion formed between the protrude portions for supplying hydraulic pressure of the oil passage to the supply hole when the engine brake operates; and
a chamber formed within the hydraulic piston and fluid-connected to the recess portion to supply hydraulic pressure of the oil passage to the supply hole through the recess portion.

2. The engine brake of claim 1, wherein the hydraulic pressure control portion further comprises a hydraulic piston stopper that is disposed between the supply hole and the exhaust hole for the hydraulic piston to close fluid communication between the exhaust hole and the supply hole and to open fluid communication between the oil passage and the supply hole when the engine brake operates.

3. The engine brake of claim 1, wherein the hydraulic pressure control portion further comprises:
a plate disposed to a front portion of the hydraulic piston and having a plate hole fluid-connected to the oil passage;
a check ball disposed between the plate and the hydraulic piston to selectively open the chamber; and
a check ball spring disposed within the chamber for elastically biasing the check ball toward the plate hole of the plate.

4. The engine brake of claim 3, wherein the hydraulic pressure supply line comprises:
rocker arm hydraulic pressure lines formed in each of the rocker arms and fluid-connected to the actuator piston;
a rocker shaft hydraulic pressure line formed in the rocker shaft and connected to the rocker arm hydraulic pressure lines for supplying hydraulic pressure thereto; and
a control portion hydraulic pressure line connecting the rocker shaft hydraulic pressure lines and the supply hole.

5. The engine brake of claim 1, wherein the engine brake further comprises a clearance adjustment screw disposed to the stopper for adjusting clearance.

6. An engine comprising the engine brake of claim 1.

7. An engine brake comprising:
a rocker shaft:,
a rocker arm pivoting around the rocker shaft;
an actuator piston disposed to the rocker arm and selectively protruded therefrom;
a stopper disposed to a corresponding position of the actuator piston with a predetermined distance for the rocker arm to open a valve when the actuator piston is protruded; and
a hydraulic pressure supply portion fluid-connected to the actuator piston and selectively supplying hydraulic pressure to the actuator piston,
wherein the rocker arms are provided as a plurality;
wherein the hydraulic pressure supply portion selectively supplies hydraulic pressure to each actuator piston disposed to the plurality of rocker arms;
wherein the hydraulic pressure supply portion includes:
a solenoid valve selectively opening an oil passage to the actuator piston;
a hydraulic pressure control portion that is opened according to hydraulic pressure in the oil passage opened by the solenoid valve; and
a hydraulic pressure supply line connecting each of the actuator pistons and the hydraulic pressure control portion,
wherein the hydraulic pressure control portion includes:
a housing connected to the solenoid valve via the oil passage;
a supply hole formed to the housing;
an exhaust hole formed to the housing:,
a hydraulic piston stopper disposed between the supply hole and the exhaust hole;
a hydraulic piston disposed within the housing; and
a hydraulic piston spring elastically biasing the hydraulic piston to open fluid communication between the supply hole and the exhaust hole in the housing,
wherein the hydraulic piston comprises:
protrude portions;
a recess portion formed between the protrude portions for supplying hydraulic pressure of the oil passage to the supply hole when the engine brake operates; and
a chamber formed within the hydraulic piston and fluid-connected to the recess portion to supply hydraulic pressure of the oil passage to the supply hole through the recess portion, and
wherein the hydraulic pressure control portion further comprises
a plate disposed to a front portion of the hydraulic piston and having a plate hole fluid-connected to the oil passage;

a check ball disposed between the plate and the hydraulic piston to selectively open the chamber; and a check ball spring disposed within the chamber for elastically biasing the check ball toward the plate hole of the plate, wherein the protrude portions close fluid communication between the supply hole and the exhaust hole when the engine brake operates, and wherein the recess portion formed between the protrude portions supplies hydraulic pressure of the oil passage to the supply hole when the engine brake operates.

8. The engine brake of claim 7, wherein the hydraulic pressure supply line comprises:

rocker arm hydraulic pressure lines formed in each of the rocker arms and fluid-connected to the actuator piston;

a rocker shaft hydraulic pressure line formed in the rocker shaft and connected to the rocker arm hydraulic pressure lines for supplying hydraulic pressure thereto; and a control portion hydraulic pressure line connecting the rocker shaft hydraulic pressure line and the supply hole.

9. An engine brake comprising:

a rocker shaft;

a plurality of rocker arms pivoting around the rocker shaft;

an actuator piston disposed to each of the plurality of rocker arms and selectively protruded therefrom;

a stopper disposed to a corresponding position of the actuator piston with a predetermined distance for the plurality of rocker arm to open a valve when the actuator piston is protruded; and a hydraulic pressure supply portion fluid-communicated to the actuator piston and selectively supplying hydraulic pressure to the actuator piston, wherein the hydraulic pressure supply portion includes:

a solenoid valve selectively opening an oil passage to the actuator piston;

a hydraulic pressure control portion that is opened according to hydraulic pressure in the oil passage opened by the solenoid valve;

a hydraulic pressure supply line connecting each of the actuator pistons and the hydraulic pressure control portion, wherein the hydraulic pressure control portion includes:

a housing connected to the solenoid valve via the oil passage;

a supply hole formed to the housing;

an exhaust hole formed to the housing;

a hydraulic piston that is movably disposed within the housing for selectively supplying hydraulic pressure of the oil passage to the hydraulic pressure supply line via the supply hole or releasing hydraulic pressure of the hydraulic pressure supply line through the exhaust hole according to operations of the solenoid valve; and a hydraulic piston spring elastically biasing the hydraulic piston to open fluid communication between the supply hole and the exhaust hole in the housing, and wherein the hydraulic piston includes:

protrude portions that close fluid communication between the supply hole and the exhaust hole when the engine brake operates;

a recess portion formed between the protrude portions for supplying hydraulic pressure of the oil passage to the supply hole when the engine brake operates; and a chamber formed within the hydraulic piston and fluid-connected to the recess portion to supply the hydraulic pressure of the oil passage to the supply hole through the recess portion.

10. The engine brake of claim 9, wherein the hydraulic pressure control portion further comprises a hydraulic piston stopper that is disposed between the supply hole and the exhaust hole for the hydraulic piston to close fluid communication between the exhaust hole and the supply hole and to open fluid communication between the oil passage and the supply hole when the engine brake operates.

11. The engine brake of claim 9, wherein the hydraulic pressure control portion further comprises:

a plate disposed to a front portion of the hydraulic piston and having a plate hole fluid-connected to the oil passage;

a check ball disposed between the plate and the hydraulic piston to selectively open the chamber; and a check ball spring disposed within the chamber for elastically biasing the check ball toward the plate hole of the plate.

12. The engine brake of claim 11, wherein the hydraulic pressure supply line comprises:

rocker arm hydraulic pressure lines formed in each of the rocker arms and fluid-connected to the actuator piston;

a rocker shaft hydraulic pressure line formed in the rocker shaft and connected to the rocker arm hydraulic pressure lines for supplying hydraulic pressure thereto; and a control portion hydraulic pressure line connecting the rocker shaft hydraulic pressure line and the supply hole.

* * * * *